US009123517B2

(12) United States Patent
Papanastasiou et al.

(10) Patent No.: US 9,123,517 B2
(45) Date of Patent: Sep. 1, 2015

(54) ION GUIDE WITH DIFFERENT ORDER MULTIPOLAR FIELD ORDER DISTRIBUTIONS ACROSS LIKE SEGMENTS

(71) Applicant: FASMATECH SCIENCE & TECHNOLOGY SA, Athens (GR)

(72) Inventors: Dimitris Papanastasiou, Athens (GR); Emmanuel Raptakis, Athens (GR)

(73) Assignee: FASMATECH SCIENCE AND TECHNOLOGY SA, Lefkippos Technology Park, NCSR Demokritos Patriarchou Grigoriou and Neapoleos Agia Paraskevi, Athens (GR)

( * ) Notice: Subject to any disclaimer, the term of this patent is extended or adjusted under 35 U.S.C. 154(b) by 0 days.

(21) Appl. No.: 13/897,373

(22) Filed: May 18, 2013

(65) Prior Publication Data

US 2013/0306861 A1 Nov. 21, 2013

(30) Foreign Application Priority Data

May 18, 2012 (GB) ..... 1208849.8

(51) Int. Cl.
*H01J 49/06* (2006.01)
*H01J 49/36* (2006.01)
*H01J 49/42* (2006.01)

(52) U.S. Cl.
CPC ..... *H01J 49/063* (2013.01); *H01J 49/062* (2013.01); *H01J 49/36* (2013.01); *H01J 49/421* (2013.01)

(58) Field of Classification Search
CPC ..... H01J 49/062; H01J 49/063; H01J 37/153; H01J 49/065; H01J 49/4225; H01J 49/4295
See application file for complete search history.

(56) References Cited

U.S. PATENT DOCUMENTS

| | | | | |
|---|---|---|---|---|
| 6,674,071 | B2 * | 1/2004 | Franzen et al. | 250/292 |
| 7,569,811 | B2 * | 8/2009 | Javahery et al. | 250/282 |
| 8,164,056 | B2 * | 4/2012 | Park et al. | 250/292 |
| 8,193,489 | B2 * | 6/2012 | Bertsch et al. | 250/292 |
| 8,212,208 | B2 * | 7/2012 | Green et al. | 250/283 |

(Continued)

FOREIGN PATENT DOCUMENTS

GB 2331837 6/1999

OTHER PUBLICATIONS

A. N. Krutchinsky, et al., Collisional Damping Interface for an Electrospray Ionization Time-of-Flight Mass Spectrometer, J Am Soc Mass Spectrom 1998, 9, 569-579.

(Continued)

*Primary Examiner* — Michael Logie
(74) *Attorney, Agent, or Firm* — Franco S. Deliguori; DP IP Group

(57) ABSTRACT

The present disclosure relates to mass spectrometers and, in particular, multipole ion guides and control units that set the RF and DC potentials at the ion guide to, among other uses, radially confine an ion beam. In an exemplary embodiment, the ion guide includes circumferentially arranged elongated rods disposed about a common axis that form longitudinally traversing segments. At least a first and a second subset of the segments have an equal number of elongated rods and are physically configured to receive respective first and a second set of RF voltage waveforms from a control unit that produce a field distribution of a first order and a field distribution of a second order, respectively, different from the first order. The ratio of the number of rods to the order of the field distribution produced is an integer number.

20 Claims, 10 Drawing Sheets

(56) References Cited

U.S. PATENT DOCUMENTS

| | | | | |
|---|---|---|---|---|
| 8,541,737 | B2 * | 9/2013 | Ibrahim et al. | 250/282 |
| 8,610,054 | B2 | 12/2013 | Giles et al. | |
| 2001/0035498 | A1 * | 11/2001 | Li et al. | 250/398 |
| 2004/0227099 | A1 * | 11/2004 | Matsuya | 250/398 |
| 2007/0057174 | A1 * | 3/2007 | Hansen | 250/282 |
| 2007/0284524 | A1 * | 12/2007 | Franzen | 250/292 |
| 2008/0048113 | A1 * | 2/2008 | Franzen et al. | 250/292 |
| 2008/0251715 | A1 * | 10/2008 | Nikolaev et al. | 250/288 |
| 2008/0265154 | A1 * | 10/2008 | Cousins et al. | 250/288 |
| 2009/0039281 | A1 * | 2/2009 | Kawasaki et al. | 250/396 R |
| 2010/0171035 | A1 * | 7/2010 | Okumura et al. | 250/289 |
| 2010/0301210 | A1 * | 12/2010 | Bertsch et al. | 250/290 |
| 2010/0308218 | A1 * | 12/2010 | Wang | 250/292 |
| 2011/0114852 | A1 * | 5/2011 | Henstra | 250/396 R |
| 2012/0056085 | A1 * | 3/2012 | Giles et al. | 250/282 |

OTHER PUBLICATIONS

A.J.H. Boerboom, et al., Ion Optics of Multipole Devices, I. Theory of the Dodecapole, International Journal of Mass Spectrometry and Ion Processes, 63 (1985) 17-28.

A.J.H. Boerboom, et al.,Ion Optics of Multipoles 2. Field Calculations and Contributions of Higher Harmonics, Intl J. of Mass Spectr. and Ion Processes 146/147 (1995) 131-138.

D.J. Douglas, Linear Quadrupoles in Mass Spectrometry, Mass Spectrometry Reviews, 2009, 28, 937-960.

A.J.H. Boerboom, et al.,Ion Optics of Multipoles, Nuclear Instruments and Methods in Physics Research A258 (1987) 426-430.

D. J. Douglas, et al.,Collisional Focusing Effects in Radio Frequency Quadrupoles,J Am Soc Mas. Spectrom 1992, 3, 398-408.

P.H. Dawson et al.. The Effective Containment of Parent Ions and Daughterions in Triple Quadrupoles . . . , Intl. J of Mass Spectrometry and Ion Physics. 42 (1982) 195-211.

* cited by examiner

ION GUIDE WITH DIFFERENT ORDER MULTIPOLAR FIELD ORDER DISTRIBUTIONS ACROSS LIKE SEGMENTS

CROSS REFERENCE TO RELATED APPLICATIONS

This application claims the benefit of U.K. Provisional Application No. 1208849.8, entitled, APPARATUS AND METHOD FOR CONTROLLING IONS, filed on May 18, 2012, commonly owned and assigned to the same assignee hereof.

This application is also related to concurrently co-pending application U.S. patent application Ser. No. 13/897,378, filed even date herewith, entitled, EFFICIENT DETECTION OF ION SPECIES UTILIZING FLUORESCENSE AND OPTICS, which claims priority to U.K. Provisional Application No. 1208843.1, entitled, IMPROVEMENTS IN AND RELATING TO MASS OR SIZE MEASUREMENT OF IONS, filed on May 18, 2012, both applications of which are also commonly owned and assigned to the same assignee hereof.

FIELD

The present disclosure relates to mass spectrometer type equipment and components, and in particular, to ion guides used therein that produce different multipolar field distributions.

BACKGROUND

Mass spectrometry (MS) is an analytical methodology used for quantitative and qualitative analysis of samples. Molecules in a sample are ionized and separated by a mass analyzer based on their respective mass-to-charge ratios. The separated analyte ions are then detected and a mass spectrum of the sample is produced. The mass spectrum may also provide information about the structural properties of the precursor masses by monitoring fragment species. In particular, mass spectrometry can be used to determine the molecular weights of molecules and molecular fragments within an analyte. Additionally, mass spectrometry can identify components within the analyte based on a fragmentation pattern.

Analyte ions for analysis by mass spectrometry may be produced by any of a variety of ionization systems. For example, Electrospray Ionization (ESI), Matrix Assisted Laser Desorption Ionization (MALDI) performed at high vacuum, intermediate or atmospheric pressure, Atmospheric Pressure Photoionization (APPI), Atmospheric Pressure Chemical Ionization (APCI) and Inductively Coupled Plasma (ICP) systems may be employed to produce ions in a mass spectrometry system. Many of these ionization sources generate ions at or near atmospheric pressure (760 Torr).

Once generated, the analyte ions are subsequently introduced into a mass spectrometer. Typically, the analyzer section of a mass spectrometer is maintained at high vacuum levels from $10^{-4}$ mbar to $10^{-8}$ mbar. In practice, sampling the ions includes transporting the analyte ions in the form of a narrowly confined ion beam from the ion source to the high vacuum mass analyzer chamber by way of one or more intermediate vacuum chambers.

Each of the intermediate vacuum chambers is preferably but not exclusively maintained at a vacuum level between that of the proceeding and following chambers. Therefore, the ion beam transports the analyte ions to progressively lower pressure vacuum regions in a stepwise manner from the pressure levels associated with ion formation to those of the mass analyzer. It is desirable to transportions through each of the various chambers of a mass spectrometer system with minimum ion losses. Often a Radio-Frequency (RF) ion guide is used to move ions in a defined direction to in the MS system.

Ion guides typically utilize RF electric fields to confine the ions radially while allowing or promoting ion transport axially. One type of ion guide generates a multipole field by application of a time-dependent voltage, which is often in the RF spectrum. These so-called RF multipole ion guides have found a variety of applications in transferring ions between parts of MS systems, as well as components of ion traps. When operated in presence of a buffer gas, RF guides are capable of reducing the velocity of ions in both axial and radial directions. This reduction in ion velocity in the axial and radial directions is known as "kinetic energy thermalization" or "translational cooling" of the ions via multiple collisions with neutral molecules of the buffer gas. Kinetically thermalized beams that are compressed in the radial direction are useful in improving ion transmission through narrow orifices of the MS system and reducing radial velocity spread in time-of-flight (TOF) instruments.

For purposes of clarity and consistency, the expression "field order of a multipole ion guide" as conventionally used in the art is meant to specifically refer to the number of electrical RF field poles produced by an equal-in-number corresponding elongated rods of an ion guide. Where the ion guide consists of multiple longitudinally traversing segments, the same expression may be used to refer to the number of electrical RF field poles produced by an equal-in-number corresponding elongated rods of a specific segment or sets of segments.

To give an example, a single segment quadrupole RF ion guide may be an ion guide (or section thereof) comprised four elongated rods. This type of multipole ion guide—when an appropriate RF potential is applied in a known sequence—is capable of producing four (4) RF field poles. The field order of the ion guide is thus commonly referred to as "order four" or "fourth order". This is because the four (4) multipolar RF field poles define an "order four" (or "fourth order"), or simply, a quadrupolar electrical RF field distribution (or "quadrupolar field distribution" for short).

A multipole ion guide forming an RF electric field distribution operates to electrically influence the trajectory of ions traveling along a longitudinal axis. An ion guide operated as a collision cell may influence ion trajectories in both radial and axial dimension due to kinetic energy transfer induced by collisions with buffer gas molecules. By influencing the trajectory, it is commonly understood to imply that the ion trajectory or path is radially compressed toward the longitudinal axis. In cases where pressure is significantly low and so the ion mean free path is greater compared to the length of the system, the multipole ion guide simply acts as a transfer device to subsequent vacuum regions or compartments.

The longitudinal axis is the axis defined by the four elongated rods. As previously explained, the rods are typically cylindrically arranged about this longitudinal axis in any given segment. As for later segments in a multi-segment arrangement, each segment is likewise comprised of a separate set of elongated rods coupled structurally, electrically, or both, to the preceding stage.

The segments of a multi-segment ion guide all cooperate to structurally define a cylindrical or cylindrical-like ion guide. This ion guide includes an entrance end and an exit end with a common axis typically shared by all the segments which extends from the entrance end to the exit end.

In a related configuration, an octapole ion guide is a guide formed or defined by eight elongated rods to produce an "octapolar" electrical RF field distribution, or simply "octapolar field distribution."

High-order field distributions are quite suitable in accepting ions characterized by extended kinetic energy and spatial spreads. Hence, from a kinetic energy and spatial spread perspective, the higher the field order distribution (meaning the greater the number of elongated rods), the greater the ion transfer efficiency. Unfortunately, high-order field distributions pose a challenge in the ability to radially compress an ion beam when travelling through an ion guide with a given narrow desired aperture disposed at the exit end. In contrast, lower order multipole ion guides exhibit a higher degree of ion radial compression at the expense, however, of the energy and spatial spreads they can tolerate.

One approach that has been proposed to deal with the challenge is to employ converging multipole rod geometries, as shown and described in U.S. Pat. No. 8,193,489. The convergence approach achieves wide kinetic energy and spatial spread acceptance in the region near or about the entrance end of the ion guide and enhanced focusing at the region near the exit end. This design approach does not provide a uniform field order distribution. If a uniform field order distribution is desirable, this approach may not be suitable. More important, the patented approach is limited by its very structure. It is not possible to, for example, provide commercially an ion guide with 24 poles (rods) which may be configurable in one or more mass spectrometers to achieve a wide range of field order distributions. This is a significant drawback in design.

Another approach is to provide a multi-segment ion guide with segments downstream having fewer elongated rods than those in segments upstream. This way, upstream segments which will be configured with higher number of rods than those downstream, and thus produce higher order field distributions, and vice versa.

Unfortunately, changing the number of rods from segment to segment introduces both design and cost challenges, and also fails to provide a suitable desired uniform field distribution. Transitions from higher order field distributions to lower order field distributions configured by a fewer number of rods are associated with fringe fields that can distort ion motion and produce significant ion losses.

What is needed, therefore, is an apparatus, which guides ions through a mass spectrometry system and that overcomes at least the shortcomings of known apparatuses.

SUMMARY

The present disclosure relates to mass spectrometers and, in particular, multipole ion guides and control units that set the RF and DC potentials at the ion guide to, among other uses, radially confine an ion beam. In an exemplary embodiment, the ion guide includes a plurality of circumferentially arranged elongated rods disposed about a common axis that form a plurality of longitudinally traversing segments. At least a first and a second subset of the segments have an equal number of elongated rods and are physically configured to receive a first and a second set of RF voltage waveforms from a control unit that results in a first multipolar field order distribution and a second multipolar field distribution, respectively, being produced that are different from one another.

DETAILED DESCRIPTION

The word "exemplary" is used herein to mean "serving as an example, instance, or illustration." Any embodiment described herein as "exemplary" is not necessarily to be construed as preferred or advantageous over other embodiments. It is to be understood that the terminology used herein is for purposes of describing particular embodiments only, and is not intended to be limiting. The defined terms are in addition to the technical and scientific meanings of the defined terms as commonly understood and accepted in the technical field of the present teachings.

As used in the specification and appended claims, the terms "a", "an" and "the" include both singular and plural referents, unless the context clearly dictates otherwise. Thus, for example, "an apparatus" or "a device" includes one apparatus or device as well as plural apparatuses or devices.

As used herein, the term "multipole ion guide" is an ion guide configured to establish a quadrupole, or a hexapole, or an octopole, or a decapole, or higher order pole RF electric field to direct ions in a beam.

In the following detailed description, for purposes of explanation and not limitation, representative embodiments disclosing specific details are set forth in order to provide a thorough understanding of the present teachings. Descriptions of known systems, devices, materials, methods of operation and methods of manufacture may be omitted so as to avoid obscuring the description of the example embodiments. Nonetheless, systems, devices, materials and methods that are within the purview of one of ordinary skill in the art may be used in accordance with the representative embodiments.

Figure 1:
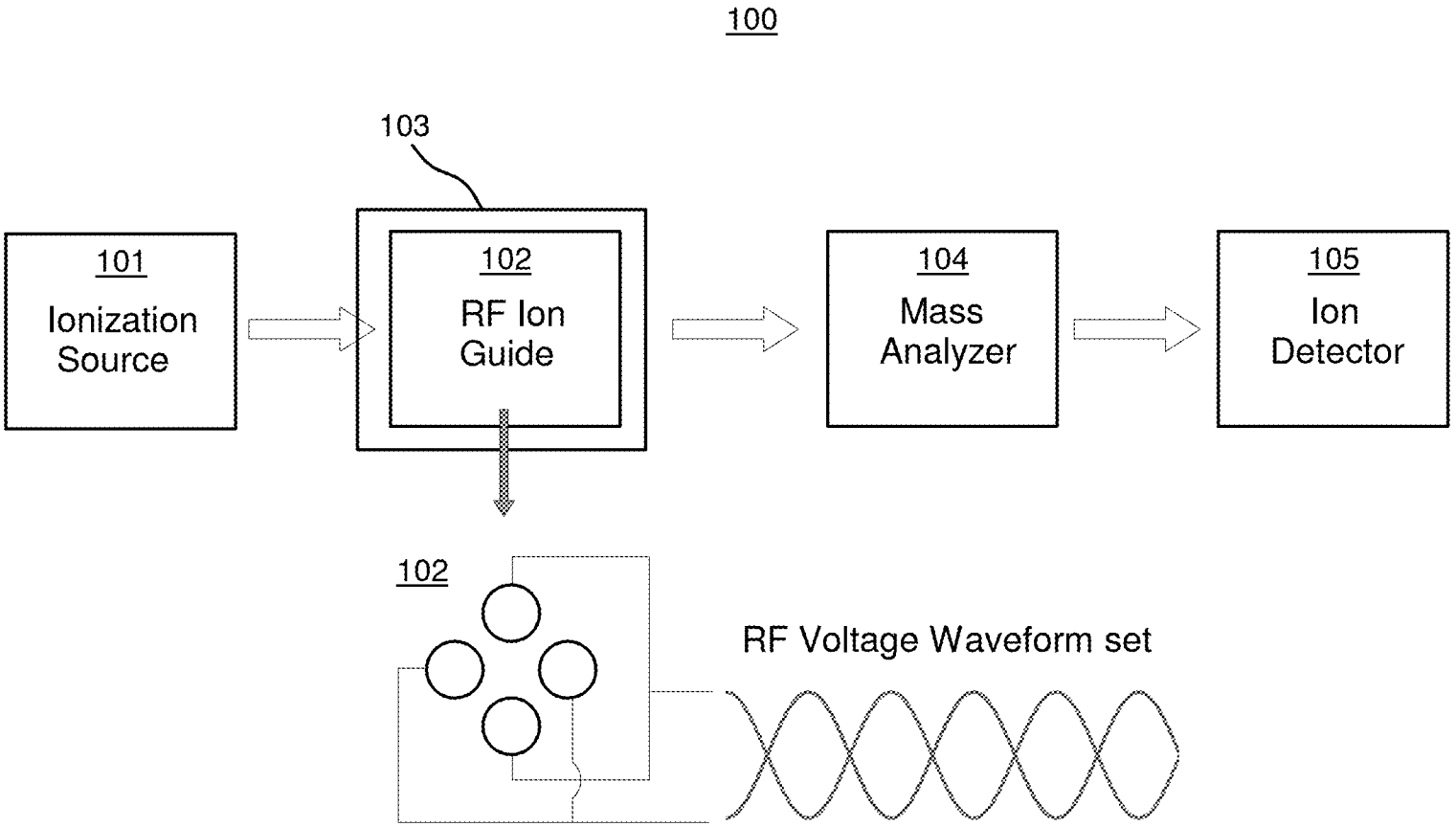
FIG. 1 shows a simplified block diagram of a mass spectrometer (MS) system in accordance with a representative embodiment.

FIG. 1 shows a simplified block diagram of an MS system 100 in accordance with a representative embodiment. The MS system 100 comprises an ionization source 101, a multipole ion guide 102, for example a quadrupole ion guide configured to receive a set of RF voltage waveforms, a chamber 103, a mass analyzer 104 and an ion detector 105. The ionization source 101 may be one of a number of known types of ionization sources. The mass analyzer 104 may be one of a variety of known mass analyzers including but not limited to a time-of-flight (TOF) instrument, a Fourier Transform MS analyzer (FTMS), an electrostatic ion trap, a quadrupole mass analyzer, a quadrupole ion trap, or a magnetic sector analyzer. Similarly, the ion detector 105 is one of a number of known ion detectors.

The multipole ion guide 102 is described more fully below in connection with representative embodiments. The multipole ion guide 102 may be provided in the chamber 103, which is configured to provide one or more pressure transition stages that lie between the ionization source 101 and the mass analyzer 104. Because the ionization source 101 is normally maintained at or near atmospheric pressure, and the mass analyzer 104 is normally maintained at comparatively high vacuum, according to representative embodiments, the multipole ion guide 102 may be configured to provide effective transmission of ions from comparatively high pressure to comparatively low pressure regions. The ionization source 101 may be one of a variety of known ionization sources, and may include additional ion manipulation devices and vacuum partitions, including but not limited to skimmers, multipoles, apertures, small diameter conduits, and ion optics.

The vacuum chamber 103 may include its own mass filter and may also include an ion guide configured to operate as a collision cell. In mass spectrometer systems comprising a collision cell in the form of a multipole ion guide 102, a neutral gas may be introduced into chamber 103 to facilitate fragmentation of ions moving through the multipole ion guide. Such a collision cell used in multiple mass/charge analysis systems where a second quadrupole mass filter is located downstream the collision cell is known in the art as "triple quadrupole" systems.

In use, ions (the path of which is shown by arrows) produced in ionization source 101 are provided to the multipole ion guide 102. The multipole ion guide 102 transfers ions and forms a comparatively confined beam having a defined phase space determined by selection of various ion guide parameters, for example the order of the field distribution, as described more fully below. The ion beam emerges from the ion guide and is introduced into the mass analyzer 104, where ion separation occurs. The ions pass from mass analyzer 104 to the ion detector 105, where the ions are detected.

Early Approaches

Early investigations on triple quadrupole systems utilized a RF quadrupole device disposed between two analytical quadrupoles to induce dissociation of parent ions via collisions with a buffer gas [Dawson P H, Fulford J E, *Int. J. Mass Spectrom. Ion Physics,* 42 (1982) 195]. In these early investigations ion scattering by buffer gas molecules was recognized as a potential source for ion losses. Collisional focusing as a result of ion cooling was demonstrated a decade later in a 2-dimensional RF frequency quadrupole device operated within a pressure range of $10^{-4}$ to $10^{-2}$ mbar and used for ion transport from high pressure regions into the first analytical quadrupole [Douglas D J, French J B, *J. Am. Soc. Mass Spectrom.* 3 (1992) 398]. In these experiments transmission increased with pressure and ion axial kinetic energy was reduced demonstrating effective kinetic energy relaxation. Collisional damping of ion kinetic energy was already discussed in experiments utilizing 3-dimensional quadrupole ion traps [Dehmelt H G, *Adv. At. Mol. Phys.* 3 (1967) 53; Stafford G C et al, *Int. J. Mass Spectrom. Ion Proc.* 60 (1984) 85].

Exemplary Embodiments

The present disclosure proposes an improved MS system 100. MS 100 includes one or more multipole ion guides and control units that set the RF and DC potentials at the ion guide(s) to, among other uses, radially confine an ion beam.

In an exemplary embodiment, the ion guide includes a plurality of circumferentially arranged elongated rods disposed about a common axis that form a plurality of longitudinally traversing segments. At least a first and a second subset of the segments have an equal number of elongated rods and are physically configured to receive appropriate RF voltage waveforms from a control unit that result in a first multipolar field order distribution and a second multipolar field distribution, respectively, being produced that are different from one another.

A multipole rod set can be used to generate field distributions of order equal or lower to the number of rods. These lower order RF fields can be produced accurately if the ratio of the number of rods to the order of the field is an integer number. The RF voltage waveforms applied to the rods of a multipole follow the relationship $V=V_o \cos(n\theta/2)$, where $V_o$ is the maximum voltage amplitude applied to one of the rods, V is the amplitude applied to remaining rods, n is the number of poles and θ is the angle of the pole.

Figure 2:
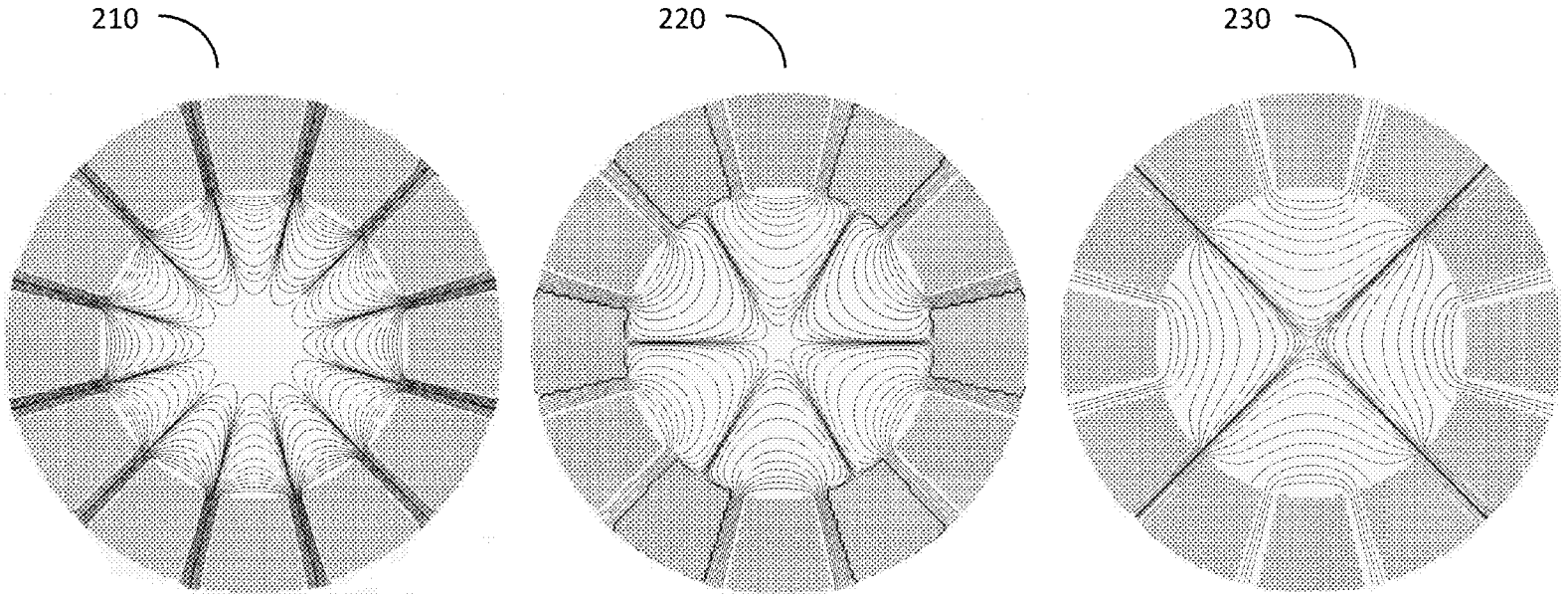
FIG. 2 shows cross sections of an ion guide apparatus comprising twelve poles forming a dodecapole geometrical structure and supplied with appropriate potentials to generate a dodecapolar field, a hexapolar field and a quadrupolar field.

FIG. 2 shows cross sections of an ion guide apparatus comprising twelve poles forming a dodecapole geometrical structure and supplied with appropriate potentials to generate (a) a dodecapolar field 210, which is the highest field order that can be produced using twelve poles, (b) a hexapolar field 220 and (c) a quadrupolar field 230. An octapolar field is poorly approximated using twelve poles because the ratio of the number of rods to the order of the field is not an integer.

Two basic modes of operation of a segmented multipole ion guide, which combine multipoles with number of poles greater than and equal to the order of the RF field distribution are disclosed and these are related to (a) the control of a continuous ion beam by utilizing consecutive multipole RF field distributions of progressively lower order, and (b) to the conversion of a continuous ion beam into packets of ions stored in a higher-order field distribution and transferred in a sequential manner to lower field distributions using potential wells established in the longitudinal direction by application of appropriate periodic DC potentials.

In the continuous mode of operation (cooling, transmission or fragmentation mode) ions are introduced axially (z direction) and radially confined by the highest order RF field distribution generated by application of sinusoidal voltage waveforms to the poles.

Rectangular, triangular or other non-linear periodic RF voltage waveforms can be employed to affect the mass range confined efficiently and adjust the low-mass cut-off of the device.

At pressures above $10^{-4}$ mbar ions confined in the RF ion guide lose energy via collisions with the buffer gas molecules and ion motion is confined near the ion optical axis of the device. The simplest configuration in this mode of operation is achieved by two multipole field distributions in series—for example an octapolar field followed by a quadrupolar field distribution—both generated by two sets of eight co-planar electrodes arranged circumferentially around a common axis.

Ions enter through the octapolar field and lose kinetic energy via collision with the buffer gas as they move toward the quadrupolar field.

The wider phase space area of acceptance that an octapolar field distribution presents at the entrance of a device enhances trapping efficiency for ions having wide kinetic energy and positional spreads. At the same time, the quadrupolar field distribution generated by the application of appropriate RF waveforms to the octapole structure and established at the exit of the ion guide compresses ions radially and narrows the phase space area of emittance.

Ions must retain sufficient kinetic energy to traverse the device in case there is no field in the longitudinal direction; therefore, pressure is limited to $<10^{-2}$ mbar for a length of ~100 mm.

The ion guide can maintain transmission at greater pressures by applying a DC offset between segments which comprise field distributions of different order. In this continuous mode of operation the device can be utilized for transportation of ions from higher to lower pressure regions or as a collision cell thereby receiving and cooling fragment ions generated with a wide kinetic energy distribution.

The device can be incorporated in the fore vacuum region of mass spectrometer 100 with directional flow utilized to transportions toward regions of lower pressure while radial focusing is progressively enhanced by multipoles of lower field order.

The ion guide can also be operated at lower pressures to produce a highly collimated ion beam for mass analysis, for example at pressures $<10^{-4}$ mbar, either using an orthogonal Time-of-Flight system or a quadrupole mass filter.

In a first exemplary embodiment, the ion guide comprises two multipole rod sets.

Figure 3:
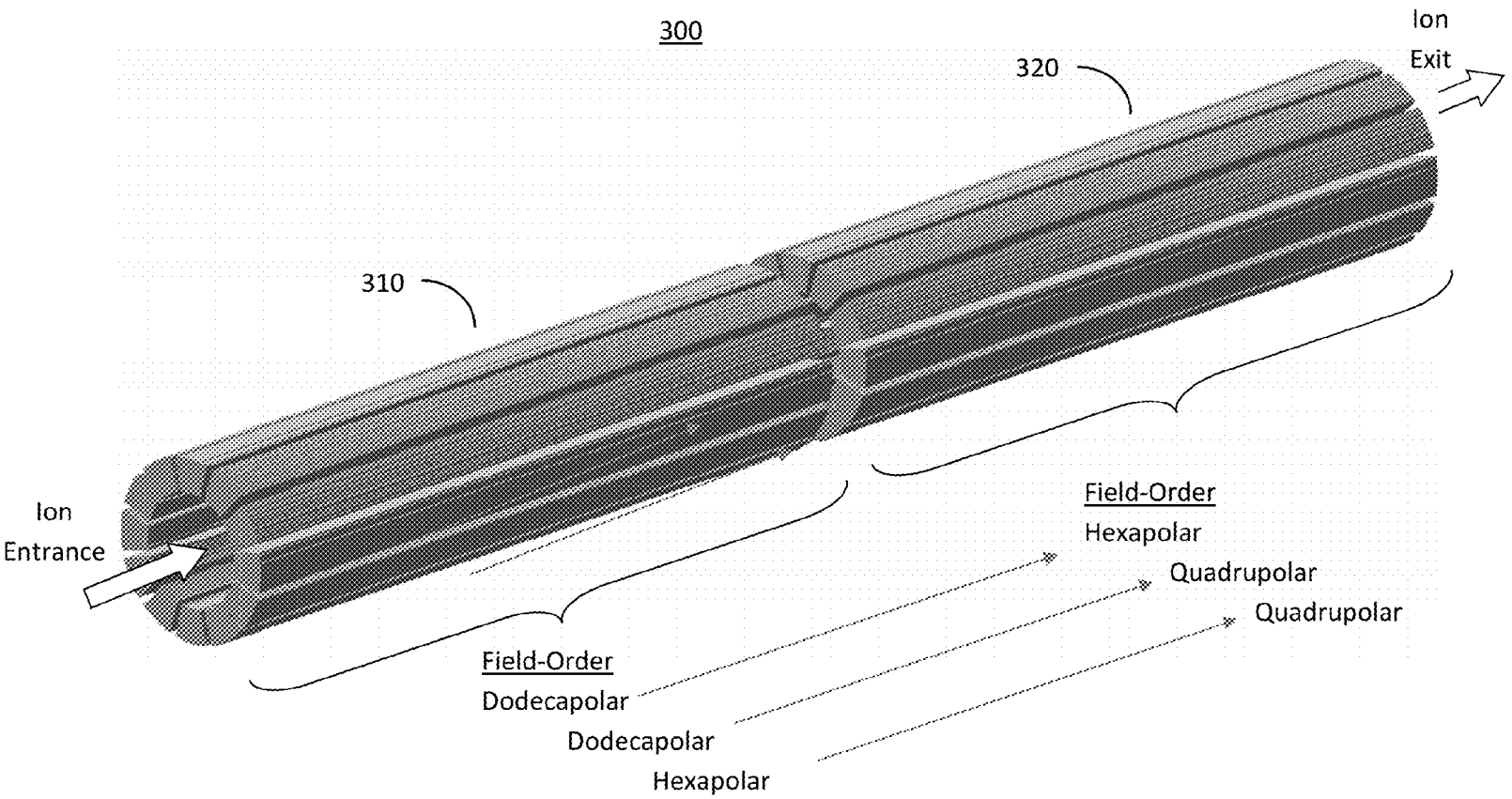
FIG. 3 shows a two-segment multipole ion guide configuration, with each segment comprised of twelve rods arranged circumferentially around a common optical axis, in accordance with an exemplary embodiment.

FIG. 3 shows a two-segment multipole ion guide configuration 300 with each segment 310, 320 comprised of twelve rods arranged circumferentially around a common optical axis, in accordance with an exemplary embodiment.

The two dodecapole rod sets are separated by a small gap, which permits the application of a DC potential along the optical axis. The RF potential distribution of the first dodecapole rod set is of a field order greater than the order generated across the consecutive dodecapole rod set.

A rod set comprised of twelve rods can be used to produce different combinations of higher-to-lower order field distributions, as shown listed in FIG. 3 below ion guide 300. These are dodecapolar-to-hexapolar, dodecapolar-to-quadrupolar, and hexapolar-to-quadrupolar field distributions.

In an alternate exemplary embodiment, a combination of three or more multipole field distributions of progressively lower field order can be configured to provide an ion guide. For example, a dodecapolar field distribution at the entrance of the ion guide may be arranged in series to a hexapolar field and finally to quadrupolar field distribution at the exit of the device. Such an arrangement is represented by reference numerals 410, 420, 430, respectively, shown in FIG. 4, described below.

In a preferred mode of operation, the RF voltage amplitude applied to the electrode-poles of the ion guide is uniform across all segments configured to produce a particular field-order. The proposed structure allows adjusting the amplitude of the RF voltage waveform applied to each of the different field-orders to control ion transmission characteristics including mass range and the low-mass cut-off of the device.

An octapole ion guide apparatus may also be configured to operate as a collision cell with enhanced performance, for example by applying greater RF voltage amplitude to the octapolar field-order and a lower RF voltage to the quadrupolar field-order in order to enhance transmission of high-mass precursor ions at the entrance and further confine fragment species by extending the low-mass cut-off to lower mass-to-charge ratios toward the exit respectively.

It is further made possible to provide the higher field-order part of the ion guide apparatus RF waveforms with increased voltage amplitude to receive and enhance trapping of ions entrained in low-pressure diffusive jet flows established in pressure limiting apertures used for separating vacuum compartments.

In an alternate exemplary embodiment, the ion guide may be configured to operate with each multipole field-order segmented further along the longitudinal direction and wherein each segment is supplied with appropriate potentials to establish a field gradient to propagate ions along the optical axis of the device. The longitudinal DC gradient allows for increasing pressure and cooling ions more efficiently. A buffer gas at elevated pressure enhances trapping of ions with greater kinetic energy and spatial distributions at the entrance of the highest-order multipole.

Translational cooling of low mass ions requires a longer ion guide since fewer collisions with buffer gas molecules occur across the apparatus. In contrast, high mass ions are thermalized significantly faster due to the greater number of collisions they experience and their kinetic energies can be reduced to levels insufficient for traversing the apparatus. It may be desirable to use heavier gas molecules, for example argon, to kinetically thermalize heavier mass ions. Operation at elevated pressure and segmentation of consecutive multipoles of progressively lower field-order is therefore desirable to control ion kinetic energy more efficiently over a shorter distance and efficiently transport a wider mass range.

Figure 4:
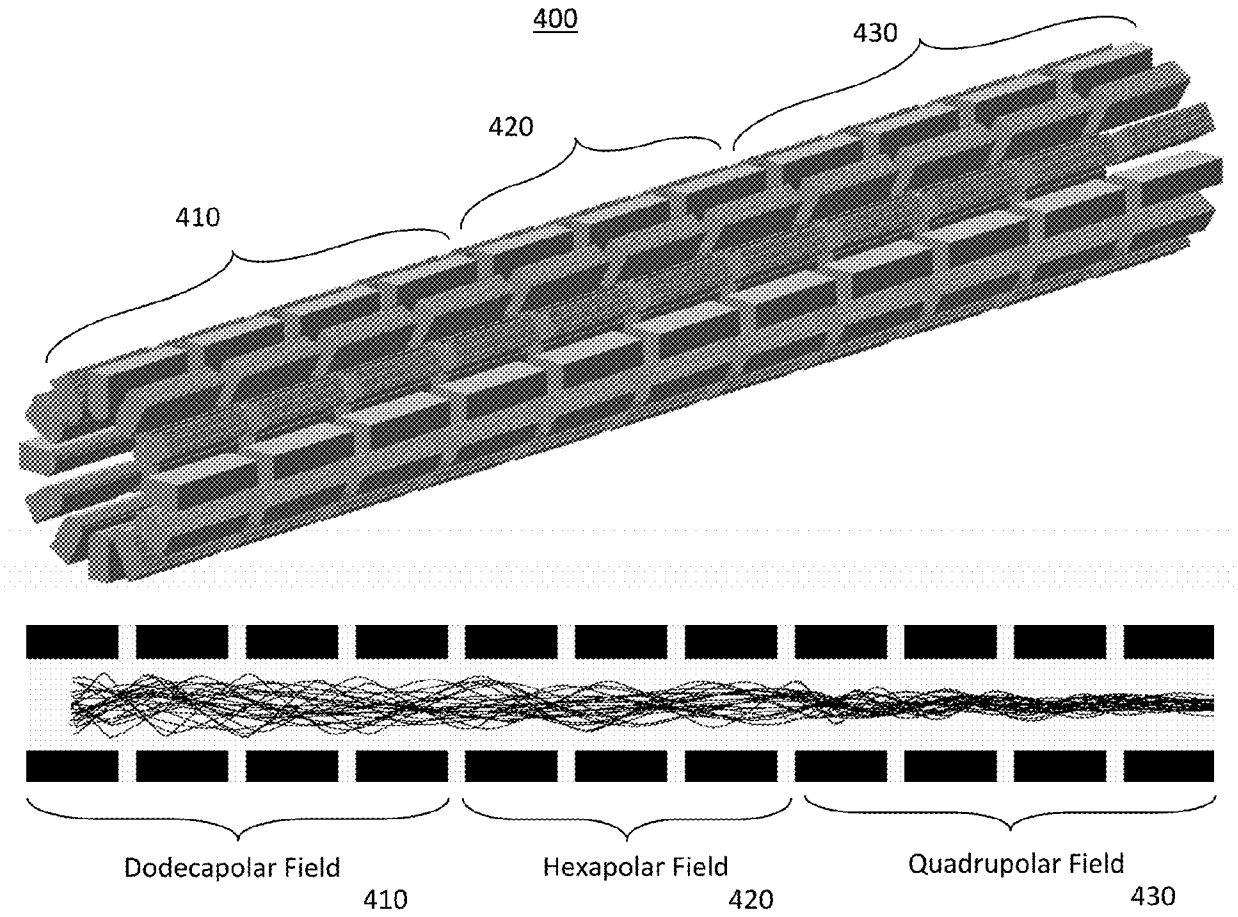
FIG. 4 shows an 11-segment ion guide in accordance with a further exemplary embodiment.

FIG. 4 shows an 11-segment ion guide 400 in accordance with a further exemplary embodiment.

Ion guide 400 is a dodecapole structure segmented along the ion optical axis. Below ion guide 400 is a graphical illustration showing the arrangement of the three RF field distributions of different order established across the ion guide to enhance trapping efficiency at the entrance and also improve the focusing properties toward the exit.

Shown are representative ion trajectories for singly charged ions at m/z=1000 injected with wide kinetic energies and spatial spreads. The ion guide shown was designed with a 5 mm inscribed radius, segment axially to form electrodes with lengths of 10 mm each. In the proposed implementation, the amplitude of the RF voltage waveform was set to $250\,V_{0\text{-}p}$ at 1 MHz. At these conditions, ions undergo hard sphere collisions with nitrogen molecules at $6\times10^{-3}$ mbar. The displayed ion trajectories demonstrate the progressive focusing that ions experience as they move from a highest-to-lowest field-order.

In an alternate exemplary embodiment, the ion guide is designed to switch the field-order applied to a group of segments electronically from a first predetermined field-order to a second predetermined field-order. Field switching is made possible by using switching technology embedded in the resistor-capacitor network used for the distribution of RF and DC signals to all electrodes and can be controlled through software. The ability to switch the field-order electronically offers flexibility and allows for optimization experiments to be carried out comfortably.

In yet another scenario, the ion guide may be utilized to accept ions having a wide phase space volume to provide an environment for translational cooling and progressive radial compression while simultaneously converting a continuous ion beam into bunches of ions. This mode of operation is particularly useful in combination with orthogonal TOF (oTOF) mass analyzers, where duty cycle can be enhanced considerably whilst ion losses are minimized.

Figure 5:
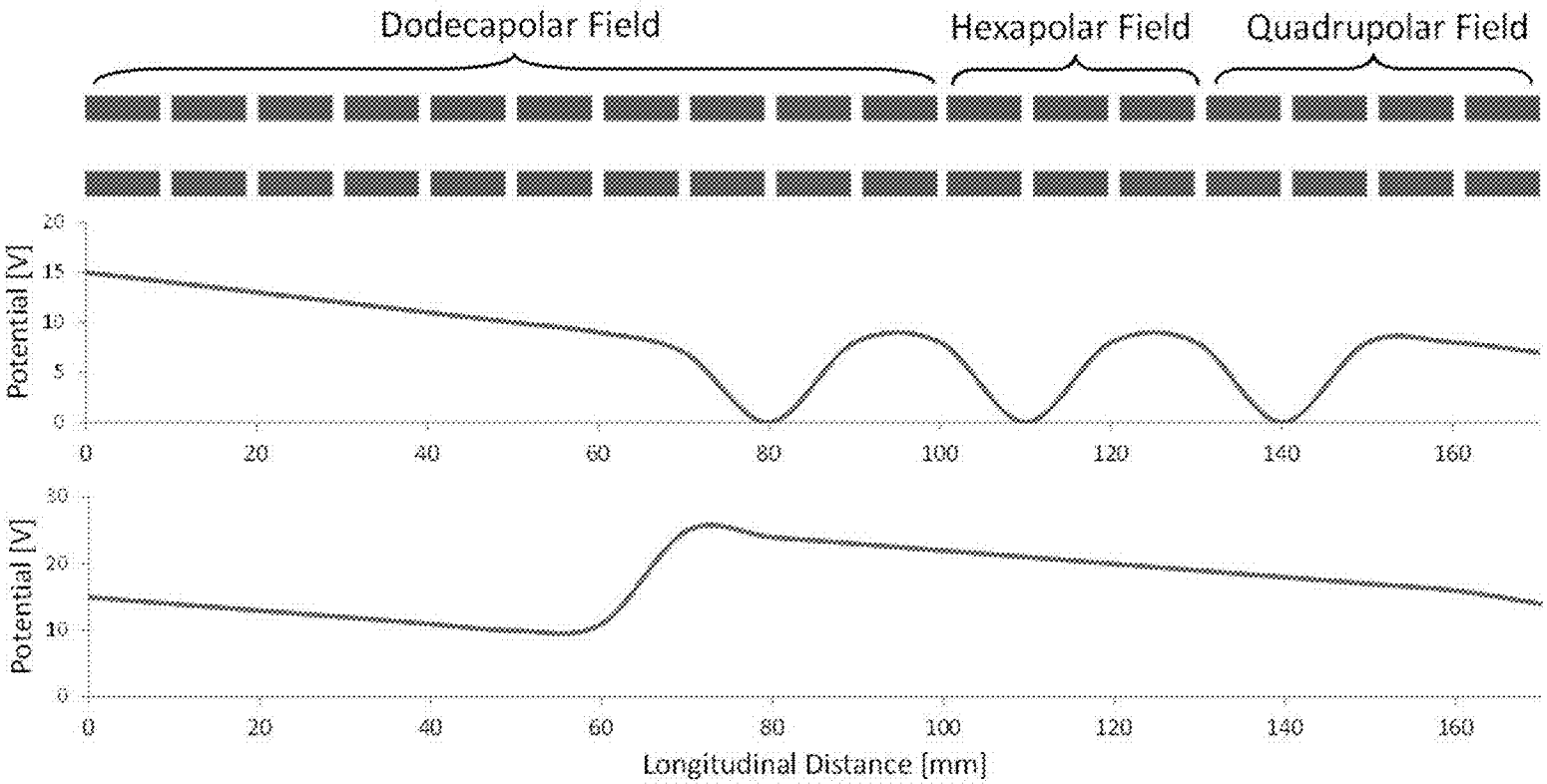
FIG. 5 shows a cross section of a segmented dodecapole (12-pole) ion guide in accordance with an exemplary embodiment.

FIG. 5 shows a cross section of a segmented dodecapole (12-pole) ion guide in accordance with an exemplary embodiment. The inscribed radius of the device is 5 mm and all segments are 10 mm long. Here, seventeen segments are used to generate the different field-order distributions for trapping ions radially. The ion guide is configured to form three regions of different RF field-orders, the first field-order is equal to the number of the poles and applied across the first ten segments.

In this ion guide structure, injected ions are translationally thermalized. The dodecapolar field distribution is followed by a shorter hexapolar field distribution and finally ions exit through a quadrupolar RF field distribution. The different field-order is generated by application of appropriate voltage waveforms on each of the twelve poles of each segment.

Graphs below the ion guide show the DC potential established along the axis of the device during trapping and transmission mode respectively. A first linear DC gradient is generated across the dodecapolar field at the entrance of the device.

Here, ions arriving at the end of the entrance section—configured to provide a dodecapolar RF field distribution—are stored in a swallow potential well (typically 5 V)—established in the longitudinal direction by application of appropriate DC offsets across the last three consecutive segments of this section.

The filling period of the dodecapolar trapping region is determined by switching to a second DC gradient configured to transportions further downstream and toward the subsequent DC trapping region in the hexapolar field section of the apparatus.

The DC gradient during transmission mode is shown in the bottom graph. The duration of the pulsed DC gradients and DC trapping zones is determined by (i) the relative distances between the trapping regions, (ii) the time ions require for covering this distance and (iii) the necessary cooling periods determined by pressure.

By "bunching" a continuous ion beam this way, a third DC trapping region is formed in the quadrupolar field section of the ion guide that receives the pulse of ions ejected from the hexapolar region. In one mode of operation, gradual focusing and bunching of a continuous ion beam is achieved by storing and transporting ions in and through three consecutive DC trapping regions of progressively lower RF field-order.

Switching between trapping and transmission mode may be performed with no losses since during each cooling period the highest field-order trapping region—in this case the DC trap established in the region where ions are trapped radially in a dodecapolar field distribution—is continuously fed with ions.

In a related mode of operation, the DC field gradient may be set as low as 0.1 V/mm to force ions toward the first trapping region. This way, ions are accumulated over 0.8 ms at ~$10^{-2}$ mbar pressure in the dodecapolar field trap. The amplitude of the RF field is kept constant and applied continuously. At the end of the 0.8 ms cooling period, a second field gradient of the order of 0.2V/mm is established across all three consecutive trapping regions and used for transporting ions across consecutive traps and also ejecting pulses of ions from the quadrupolar trap further downstream. In one scenario, the proposed field gradient may be applied for 0.2 ms.

Figure 6:
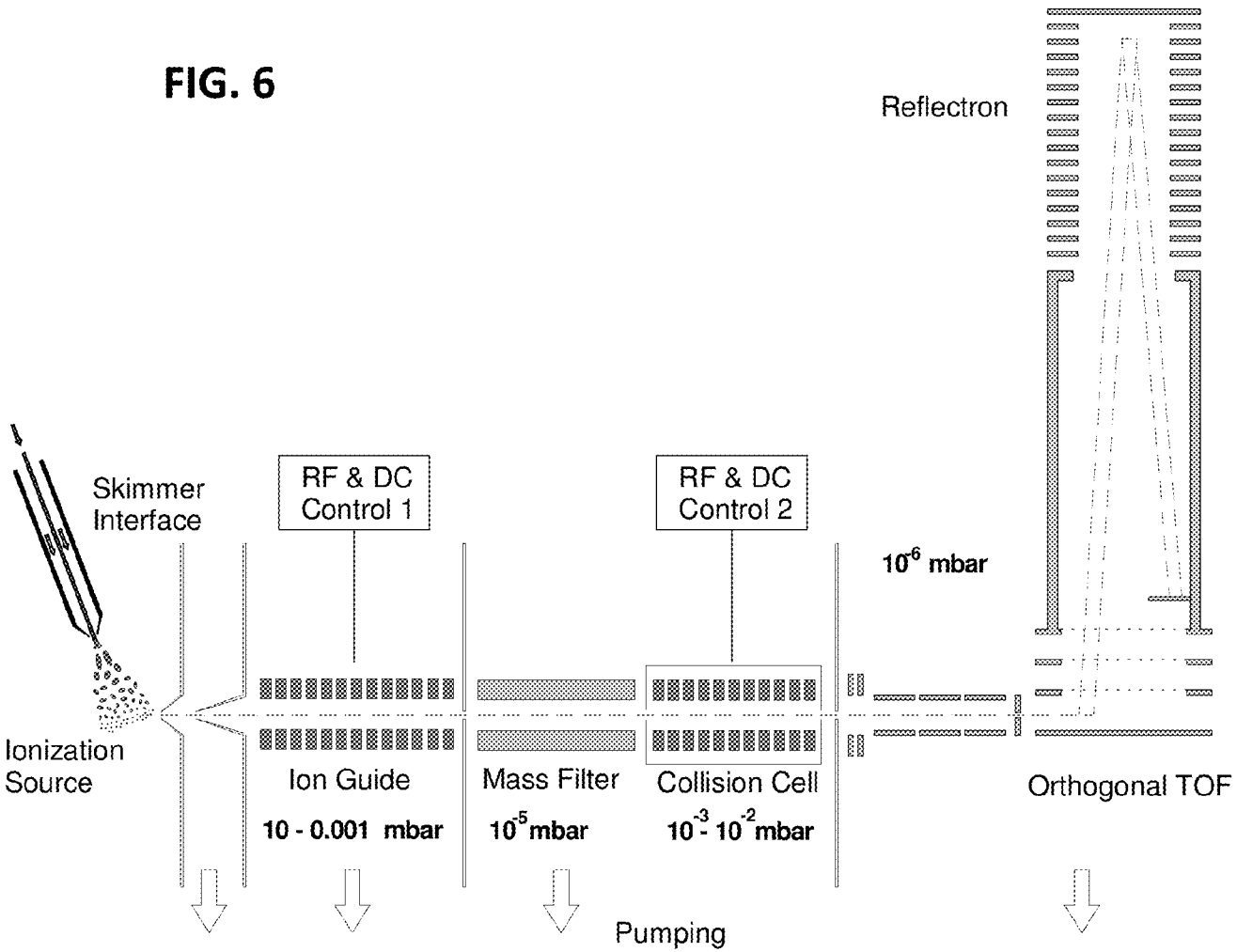
FIG. 6 shows a mass spectrometer, in accordance with a further exemplary embodiment, equipped with a first ion guide at the fore vacuum region and with a second ion guide downstream from the first ion guide with the latter configured to operate as a collision cell.

FIG. 6 shows MS, in accordance with a further exemplary embodiment, equipped with a first ion guide at the fore vacuum region and with a second ion guide downstream from the first ion guide with the latter configured to operate as a collision cell.

Referring to FIG. 6, ions are generated by electrospray ionization, though it should be appreciated that other types of ionization techniques may be employed.

In the illustrated embodiment, a skimmer inlet is used to transmit ions into a first vacuum region. A first pumping region is established between the inlet and a second skimmer-lens whereby pressure is reduced to ~100 bar or lower.

A second vacuum compartment encloses the ion guide which is configured to receive a supersonic gas jet entrained with ions. The ion guide is characterized by a first section configured to provide a higher-order RF field distribution, the higher field-order being preferably matched to the number of poles of the ion guide.

The operating pressure at this stage of the instrument falls between 10 bar and $10^{-3}$ mbar. In one scenario, the higher-order field distribution at the entrance of the ion guide is operated at increased voltage amplitude to enhance radial trapping of ions. The lowest field-order toward the exit of the device permits focusing ions through subsequent narrow apertures more effectively compared to having a uniform field-order running across the entire length of the ion guide. The RF and DC potentials applied to all ion guide electrode-poles are controlled electronically through a controller positioned externally to the vacuum chamber. All RF and DC signals are provided through high-voltage vacuum feedthroughs.

It is possible for a first stage of mass analysis to be performed using a quadrupole mass filter situated downstream the ion guide with the ion guide also acting as an ion cooler that thermalizes ions kinetically.

Thus, ions can be selectively transmitted through the mass filter, injected and fragmented in a collision cell, and also configured to form a higher field-order distribution at the entrance to capture precursor ions and a lower field-order distribution toward the exit to radially confine fragment species.

All RF and DC signals necessary to drive the collision cell electrode-poles are similarly controlled through a second controller. Finally, fragment ions can be sampled by an orthogonal Time-of-Flight mass analyzer. The mass-to-charge ratio of fragment and/or precursor ions can also be performed using multi-pass or multi-turn TOF systems, a second quadrupole mass filter or other types of trapping systems including the orbitrap or other Fourier Transform-based mass analyzers.

A first ion guide that is configured to operate as an ion cooler and a second ion guide that is configured to operate as a collision cell—substantially as proposed in the embodiment of FIG. 6—is operated in transmission mode and a set of DC potentials applied to segments may ensure propagation of ions.

Figure 7:
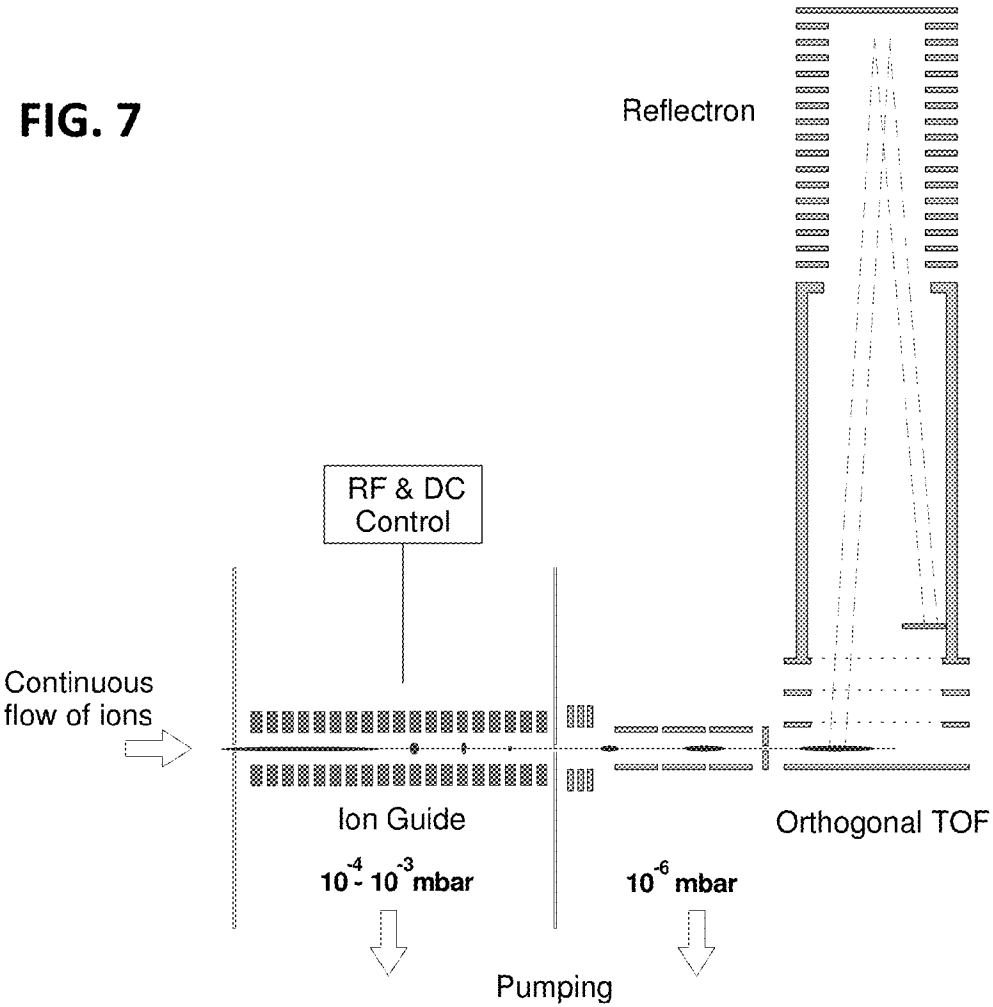
FIG. 7 shows an ion guide apparatus operated in the bunching mode and coupled to an orthogonal time-of-flight mass analyzer for enhancing duty cycle and instrument sensitivity.

FIG. 7 shows an ion guide apparatus operated in the bunching mode and coupled to an orthogonal time-of-flight mass analyzer for enhancing duty cycle and instrument sensitivity.

In bunching mode, the ion guide is able to accept a continuous flow of ions at the entrance and produce periodic pulses of ions at the exit of the device. The bunching mode was earlier described in greater detail in connection with the discussion of FIG. 5.

By matching the bunching frequency of the ion guide to the sampling frequency of an oTOF analyzer, duty cycle and instrument sensitivity is enhanced. The ion guide may also be operated in the continuous mode in this particular configuration, simply to enhance transmission through narrow apertures. A control unit is separately provided and configured to electronically switch from bunching mode to transmission mode.

In a further exemplary embodiment, the ion guide is configured to include converging and/or diverging segments disposed at the exit and entrance ends of the device respectively. A converging segment of the lower-order field distribution provides a mechanism for compressing phase space of ions to enhance transmission through narrow apertures. A diverging segment of the higher-order field distribution is used to counteract the radial expansion of ions entrained in low pressure diffusive jets.

Figure 8:
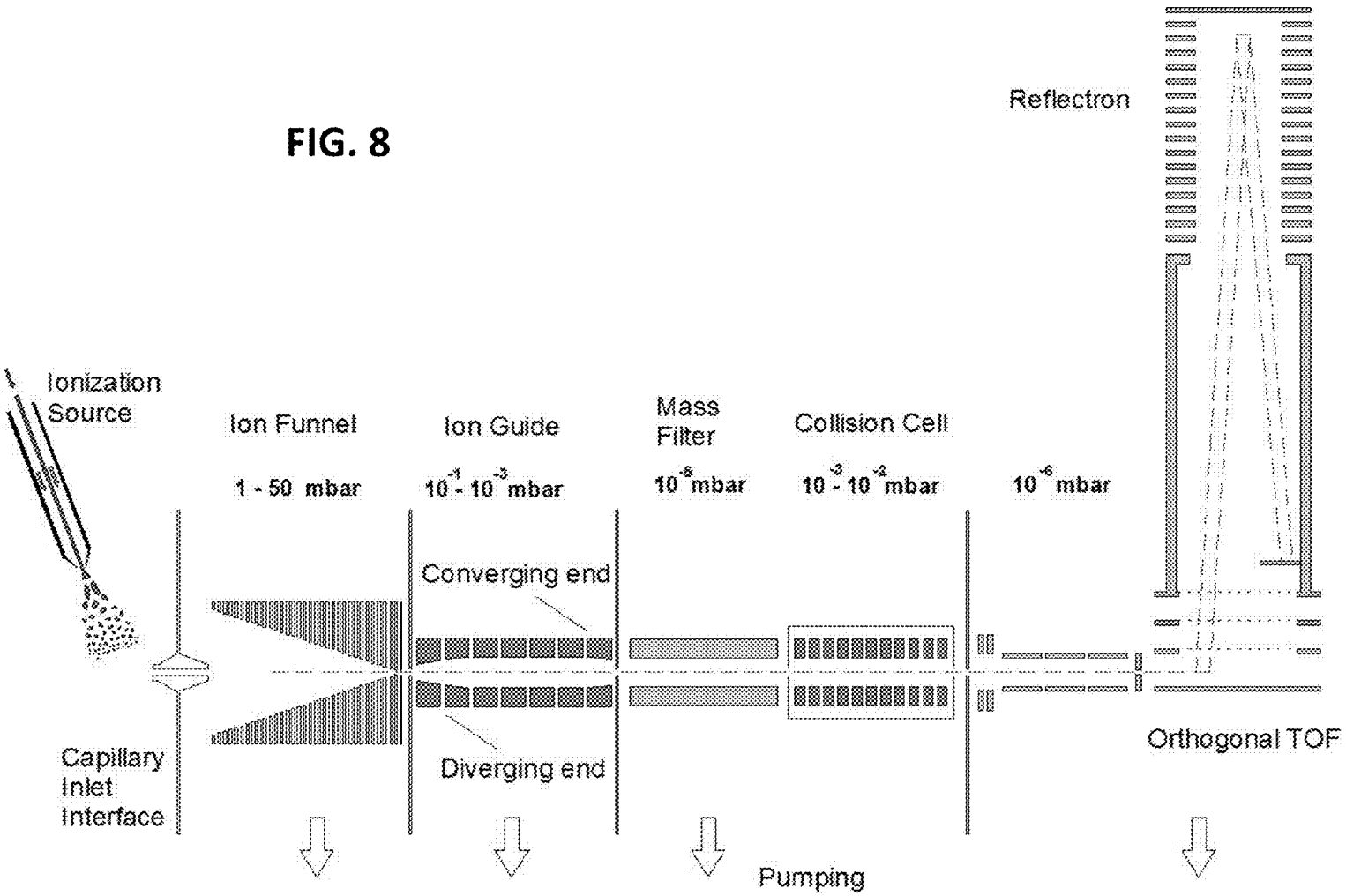
FIG. 8 shows a MS including an ion guide apparatus disposed in the second vacuum region and configured with diverging and converging segments at the entrance and exit ends respectively for enhanced radial compression of ions.

FIG. 8 shows a MS including an ion guide apparatus disposed in the second vacuum region and configured with diverging and converging segments at the entrance and exit ends respectively for enhanced radial compression of ions.

Referring to FIG. 8, the ion guide disposed in the second vacuum region is operated between $10^{-1}$ and $10^{-3}$ mbar. Ions are generated by way of electrospray ionization at atmospheric pressure and transferred through a heated capillary inlet to the fore vacuum region of the mass spectrometer. An ion funnel or other types of RF ion optical devices known to those skilled in the art of mass spectrometry are arranged to accept the supersonic jet and transfer ions to subsequent vacuum compartments through a pressure limiting aperture with a typical diameter within the range of 0.5 to 2.5 mm.

The radial velocity components of the diffusive jet established beyond the pressure limiting aperture may exceed 600 m/s and a strong electric field must be applied to prevent ions from being lost on the poles of the ion guide.

In contrast to the supersonic jet emanating from the capillary inlet, the penetration depth of the low pressure diffusive jet is of the order of 50 mm Consequently, the diverging region of the ion guide may be limited to the first two segments with typical lengths for each segment of the order of 10-20 mm. Similar to the diverging higher-order field distribution at the entrance of the ion guide apparatus—that is configured by shaping the first two segments in order to capture and confine ions with a wide kinetic energy spread—a converging end in the lower-order field distribution of the ion guide may also provide a mechanism for enhancing ion transmission by compressing phase space of ions in the radial dimension further.

The diverging and converging elements of the ion guide are highlighted in FIG. 8. In an exemplary scenario, ions are subsequently transferred through a second pressure limiting aperture toward a quadrupole mass filter followed by a collision cell, also configured to provide a higher-order field distribution at the entrance and a lower field-order toward the exit. Mass analysis is preferably but not exclusively performed using an orthogonal time-of-flight mass analyzer.

In cases where terminating apertures are employed for separating vacuum regions of different pressure, as discussed in previously described embodiments (see FIGS. 6-8), the ion guide is preferably operated at a substantially uniform pressure.

In an alternate approach, the ion guide may be extended from a first vacuum compartment operated at a first pressure to a second vacuum compartment operated at a second pressure thereby establishing a pressure gradient across the device.

Figure 9:
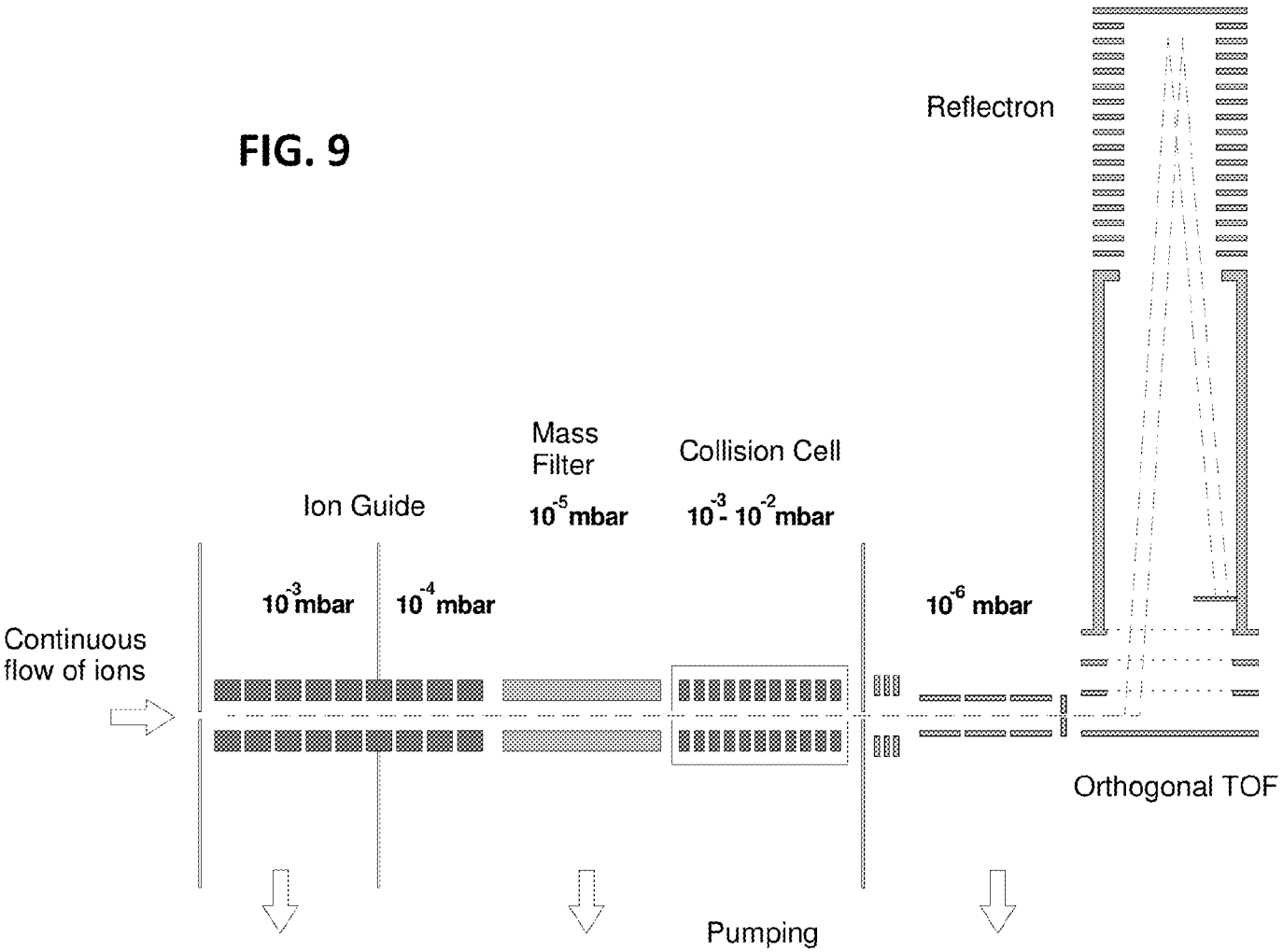
FIG. 9 shows an ion guide disposed across two consecutive vacuum regions and configured to provide a quadrupolar field distribution at an exit end to match an RF field of a quadrupole mass filter.

FIG. 9 shows an ion guide disposed across two consecutive vacuum regions and configured to provide a quadrupolar field distribution at an exit end to match an RF field of a quadrupole mass analyzer.

Referring to FIG. 9, the ion guide shown extends from a first vacuum region—that is evacuated by a turbomolecular pump that operates at approximately at $10^{-3}$ mbar—to a second vacuum region that is evacuated by a second turbomolecular pump that operates at a reduced pressure of $10^{-4}$ mbar or lower. In this example mode of operation, the lower field-order at the exit end of the ion guide is configurable to provide a quadrupolar distribution to substantially match the field of the quadrupole mass filter thereby ensuring smooth transition of the ions with no losses.

Figure 10:
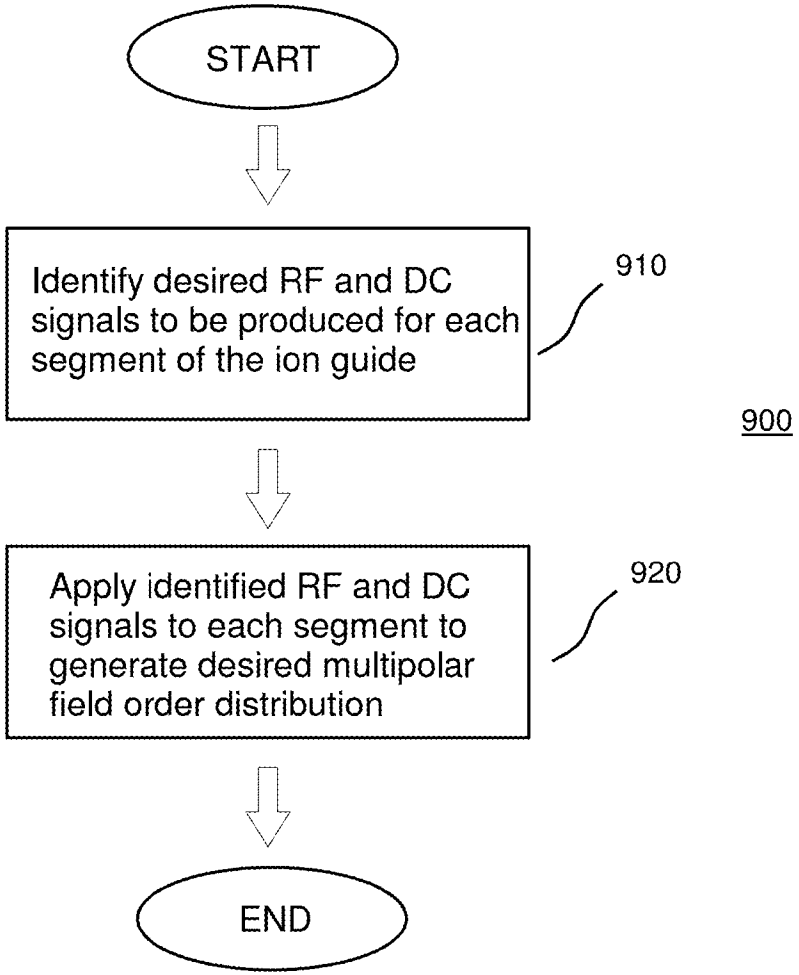
FIG. 10 is an operational flow diagram for identifying and applying appropriate RF and DC potentials to an ion guide in accordance with an exemplary embodiment.

FIG. 10 is an operational flow diagram 900 for identifying an applying appropriate RF and DC potentials to an ion guide in accordance with an exemplary embodiment.

A control unit (or units) is provided to identify and execute a set of instructions to cause the MS to utilize ion guides, as proposed herein, to operate in accordance with the exemplary embodiments set out above.

Specifically, the control unit identifies the desired RF and DC signals to be produced for each segment of the multipole ion guide (step 910), and in turn applies the identified RF and DC signals to each segment to generate the corresponding multipolar field order distribution for that segment (step 920).

The ion guide apparatus disclosed herein is subject but not limited to the preferred embodiments described in detail and readily identifiable to those skilled in the art of mass spectrometry and RF ion guide design and method of use. For example surface resistive spacers can be introduced between poles of the ion guide to reduce fringe-field effects in regions of transition from a higher-order field to a lower-order field.

It may also be desirable to fill the gap between poles to form a duct and channel a low pressure flow. Other examples falling within the scope of the present invention may be related to combining more than one rod to form a single pole of the multipole field distribution.

In view of this disclosure, it is noted that the methods and apparatuses can be implemented in keeping with the present teachings. Further, the various components, materials, structures and parameters are included by way of illustration and example only and not in any limiting sense. In view of this disclosure, the present teachings can be implemented in other applications and components, materials, structures and equipment to needed implement these applications can be determined, while remaining within the scope of the appended claims.

Those of skill in the art would understand that information and signals may be represented using any of a variety of different technologies and techniques. For example, data, instructions, commands, information, signals, bits, symbols, and chips that may be referenced throughout the above description may be represented by DC voltages, currents, RF voltage waveforms and corresponding electric fields, or any combination thereof.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments of the invention.

The various illustrative logical blocks, modules, and circuits described in connection with the embodiments disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An apparatus including an ion guide to confine ions radially therethrough, the ion guide having a plurality of circumferentially arranged elongated rods disposed about a common axis and forming a plurality of longitudinally traversing segments, where at least a first and a second subset of the segments have an equal number of elongated rods in a multiple of two and are physically configured in angular positions (θ) about said axis to receive a first and a second set of symmetric RF voltage waveforms (V) that are applied to the first and second subsets of segments in accordance with the relationship $V=V_0 \cos(n\theta/2)$ and that produce multipolar field distributions of a given order (n) equal to or lower than the number of rods, respectively, where $V_0$ is the maximum voltage applied, where the first set of symmetric RF voltage waveforms produce a field distribution of a first order and the second set of symmetric RF voltage waveforms produce a field distribution of a second order that is different from the first order, where the ratio of the number of rods to the order of the field distribution produced thereby is an integer number, where the first subset of segments is positioned closest to an entrance end of the ion guide, and where the first order field distribution is of higher order than that of the second order field distribution.

2. The apparatus of claim 1, wherein each of the first order field distribution and the second order field distribution includes any one of a dodecapolar, decapolar, octapolar, hexapolar and quadrupolar field distribution.

3. The apparatus of claim 1, wherein the first subset of segments is further configured to receive a first DC potential which is different than a second DC potential received by the second subset of segments.

4. The apparatus of claim 3, wherein the first and second subsets of segments are both comprised of eight rods with the first subset of segments being configured to generate an octapolar field distribution in response to the first set of symmetric RF voltage waveforms, and the second subset of segments being configured to generate a quadrupolar electric field distribution in response to the second set of symmetric RF voltage waveforms.

5. The apparatus of claim 3, wherein the plurality of longitudinally traversing segments further comprise a third subset of segments, wherein the first, second and third subsets of segments are all comprised of twelve rods with the first subset of segments being configured to generate a dodecapolar field distribution in response to the first set of symmetric RF voltage waveforms, the second subset of segments being configured to generate a hexapolar field distribution in response to the second set of symmetric RF voltage waveforms, and the third subset of segments being configured to generate a quadrupolar field distribution in response to a third set of symmetric RF voltage waveforms.

6. The apparatus of claim 5, wherein the first subset of segments is further configured to receive a first DC potential which is different than a second DC potential received by the second subset of segments, and the third subset of segments is configured to receive a third DC potential which is different from the first and second subsets of segments.

7. The apparatus of claim 1, wherein the ion guide is configured to electronically switch the field order of any of the first subset of segments and the second subset of segments.

8. The apparatus of claim 1, wherein the ion guide operates to provide effective transmission of ions from a higher pressure region to a lower pressure region.

9. The apparatus of claim 1, wherein the ion guide functions as one of an ion cooler and a collision cell.

10. The apparatus of claim 1, wherein the ion guide provides radial compression of an ion beam moving from the entrance end to an exit end of the ion guide.

11. The apparatus of claim 1, wherein the first and second subset of segments are staged from higher order field distribution to lower order field distribution and the ion guide is configured to generate a DC electric field gradient to drive ions from the higher order field distributions produced at the first subset of segments to the lower order field distributions produced at the second subset of segments.

12. The apparatus of claim 1, wherein the ion guide is configured to receive periodic DC electric pulses that are applied to the segments at different multipolar field order distributions to form discrete potential regions at fixed positions along the ion guide and arranged to trap ions in a longitudinal direction while also cooling ions via collisions.

13. The apparatus of claim 12, wherein the periodic DC electric pulses are sequenced in time to trap and release ions progressively as they transverse from higher multipolar field order distributions to lower multipolar field order distributions along the ion guide.

14. The apparatus of claim 13, wherein the trap and release of ions progressively operates to convert a continuous ion beam into ion packets.

15. A mass spectrometer including a control unit and an ion guide to confine ions radially therethrough, the ion guide having a plurality of circumferentially arranged elongated rods disposed about a common axis and forming a plurality of longitudinally traversing segments, where at least a first and a second subset of the segments have an equal number of elongated rods in a multiple of two and are physically configured in angular positions (θ) about said axis to receive a first and a second set of symmetric RF voltage waveforms (V) from the control unit that are applied to the first and second subsets of segments in accordance with the relationship $V=V_0 \cos(n\theta/2)$ and that produce multipolar field distributions of a given order (n) equal to or lower than the number of rods, respectively, where $V_0$ is the maximum voltage, where the first set of symmetric RF voltage waveforms produce a field distribution of a first order and the second set of symmetric RF voltage waveforms produce a field distribution of a second order that is different from the first order, where the ratio of the number of rods to the order of the field produced thereby is an integer number, where the first subset of segments is positioned closest to an entrance end of the ion guide, and where the first order field distribution is of higher order than that of the second order field distribution.

16. The mass spectrometer of claim 15, further comprising at least a further ion guide disposed downstream from the ion guide, where the further ion guide also includes a plurality of circumferentially arranged elongated rods disposed about a common axis that form a plurality of longitudinally traversing segments, where at least a first and a second subset of the segments of the further ion guide also have an equal number of elongated rods and are physically configured to receive a first and a second set of symmetric RF voltage waveforms from the control unit that produce a field distribution of a first order and a field distribution of a second order, respectively, different from the first order, and where the ratio of the number of rods to the order of the field distribution produced thereby is an integer number.

17. A method of confining ions radially traversing an ion guide in a mass spectrometer, where the ion guide is characterized by a plurality of circumferentially arranged elongated rods disposed in angular positions (θ) about a common axis and forming a plurality of longitudinally traversing segments, where at least a first and a second subset of the segments have an equal number of elongated rods in a multiple of two, to receive respectively a first and a second set of symmetric RF voltages, comprising:

generating, at a control unit, a first and a second set of symmetric RF voltage waveforms (V) that are applied to the first and second subsets of segments in accordance with the relationship $V=V_0 \cos(n\theta/2)$ and that produce multipolar field distributions of a given order (n) equal to or lower than the number of rods, respectively, where $V_0$ is the maximum voltage applied, where the first set of symmetric RF voltage waveforms produce a field distribution of a first order and the second set of symmetric RF voltage waveforms produce a field distribution of a second order that is different from the first order, where the ratio of the number of rods to the order of the field produced thereby is an integer number, where the first subset of segments is positioned closest to an entrance end of the ion guide, and where the first order field distribution is of higher order than that of the second order field distribution.

18. The method of claim 17, further comprising generating, at the control unit, periodic DC electric pulses that are applied to the first and second subsets of segments at different multipolar field order distributions to form discrete potential regions at fixed positions along the ion guide and arranged to trap ions in a longitudinal direction while also cooling ions via collisions.

19. The method of claim 18, wherein the periodic DC electric pulses are sequenced in time to trap and release ions progressively as they transverse from higher multipolar field order distributions to lower multipolar field order distributions along the ion guide.

20. The method of claim 19, wherein the trap and release of ions progressively operates to convert a continuous ion beam into ion packets.

* * * * *